United States Patent [19]

Danis

[11] 4,075,999

[45] Feb. 28, 1978

[54] HARD FACING ALLOY FOR ENGINE VALVES AND THE LIKE

[75] Inventor: Louis J. Danis, Battle Creek, Mich.

[73] Assignee: Eaton Corporation, Cleveland, Ohio

[21] Appl. No.: 585,272

[22] Filed: Jun. 9, 1975

[51] Int. Cl.[2] ..... F02B 19/00; F01L 3/04; B32B 15/04

[52] U.S. Cl. ..... 123/191 A; 123/188 AA; 123/188 S; 428/679; 428/680

[58] Field of Search ..... 29/194, 196.1, 196.6; 123/188 R, 188 AA, 188 VA, 188 S, 188 SA, 191 A, 191 S, 191 SP; 428/679, 680

[56] References Cited

U.S. PATENT DOCUMENTS 2,392,821 1/1946 Kreag ..... 29/196.6

*Primary Examiner*—R. Dean

*Attorney, Agent, or Firm*—J. R. Teagno

[57] ABSTRACT

A hard surfacing, high temperature alloy comprising chromium and molybdenum in a nickel base having up to about 3.5 weight percent carbon, and structures surfaced therewith.

7 Claims, 1 Drawing Figure

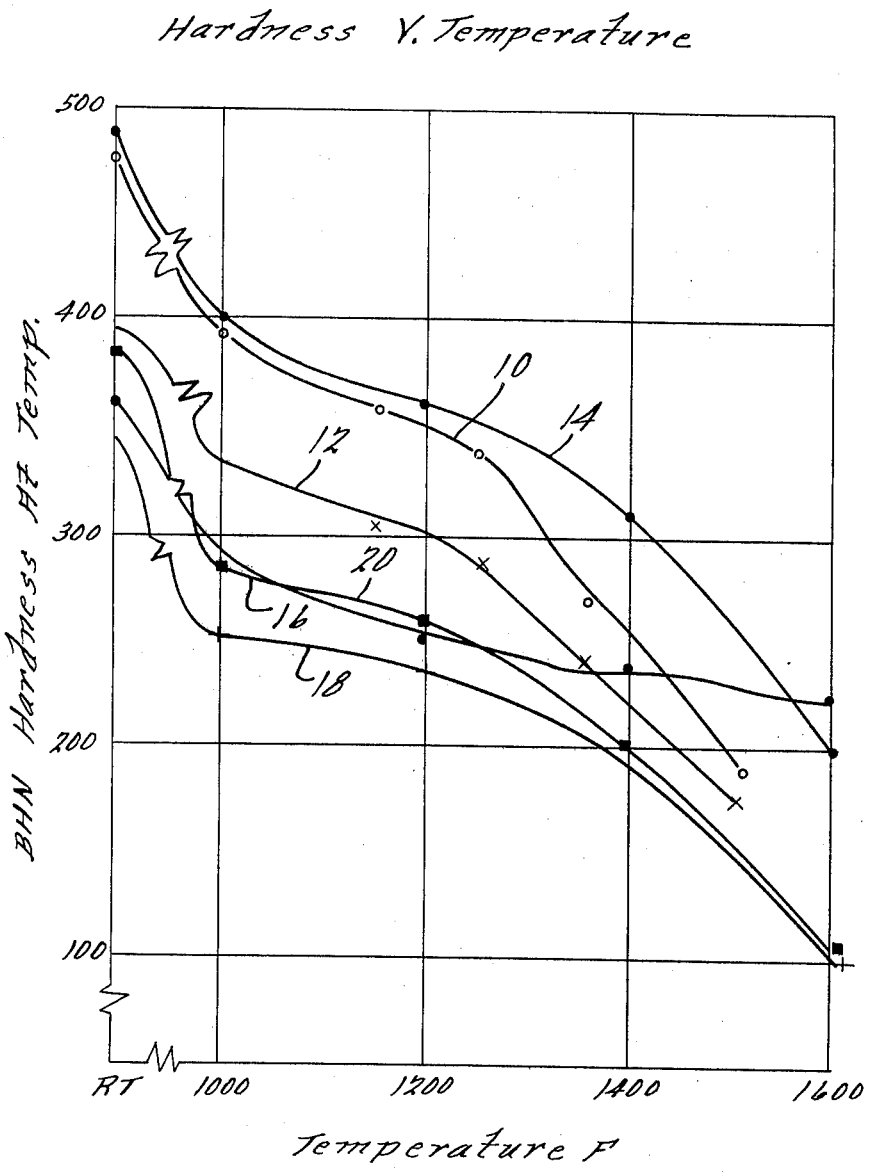
Hardness V. Temperature
500
400
300
200
100
BHN Hardness At Temp.
10
12
14
16
18
20
RT
1000
1200
1400
1600
Temperature F

HARD FACING ALLOY FOR ENGINE VALVES AND THE LIKE

BACKGROUND OF THE INVENTION

1. Field of the Invention

In one aspect this invention relates to high temperature alloys. In a further aspect, this invention relates to hard surfacing alloys. In yet a further aspect, this invention relates to nickel base alloys. In another aspect this invention relates to parts surfaced with or cast from nickel based alloys.

2. Prior Art

The prior art high temperature alloys have been dominated by cobalt based materials containing substantial amounts of tungsten and chromium as alloying elements with or without substantial amounts of other metals. Cobalt and tungsten are strategically scarce materials. They are severely limited in supply and at times are difficult to obtain due to the unstable political condition of the countries where their ores are mined. Further, cobalt based, tungsten bearing, alloys are expensive because of the scarcity of the main constituents.

BRIEF SUMMARY OF THE INVENTION

It is an object of this invention to formulate a temperature resistant alloy which is essentially free of cobalt and tungsten. It is a further object of this invention to furnish an improved heat, corrosion and abrasion resistant hard facing alloy suitable for use at elevated temperatures. It is yet a further object of this invention to provide an alloy with higher resistance to oxidation and lead oxide in an internal combustion engine environment.

The disadvantages of the prior art alloys are solved by use of the hard surfacing, high temperature nickel based alloy of this invention. The alloy has about 40 to 70 weight percent nickel, about 1 to 3.5 weight percent carbon, about 25 to 40 weight percent chromium and about 3 to 12 weight percent molybdenum. Certain impurities and residual elements in recycled scrap commonly associated with alloys of the main alloying constituents can also be present.

In one feature of this invention a structural element, such as an engine valve, valve seat or precombustion chamber, is surfaced with one of the nickel based alloys defined hereinbefore. Such elements have an abrasion resistant surface which performs well at elevated temperatures due to the good high temperature hardness of the alloy. Such structural elements also will have a greatly extended lift. Oxidation or corrosion due to lead or other oxides is delayed because of the alloy surface which resists the corrosive effects present in an internal combustion engine. The structural element has these advantages despite being coated with an alloy which is substantially free of cobalt and tungsten.

As a further feature of this invention a structural element can be cast from the alloy described above. The cast parts have the same high temperature hardness and corrosion resistance as the surfaced parts.

BRIEF DESCRIPTION OF THE DRAWING

In the accompanying drawing the FIGURE represents a graph of hardness versus temperature for six different alloy compositions.

DESCRIPTION OF THE PREFERRED EMBODIMENTS

The alloys of this invention are nickel based alloys containing approximately 40 to 70 weight percent nickel. Nickel as a base metal imparts a good oxidation resistance and high temperature hardness. This is particularly true when combined with the alloying elements used in the practice of this invention.

To the nickel base of this alloy is added a substantial amount of chromium, the chromium generally present in an amount from about 20 to 40 percent by weight. Chromium is added as an alloying element because it confers good oxidation resistance on the alloy particularly at elevated temperatures, such as, 1000° - 1200° F. The chromium present helps insure the formation of a tight adherent oxide scale on the surface of the alloy. The oxide adhering to the alloy surface prevents further oxidation of the underlying metal. This is particularly true in the preferred range of 25 to 40 weight percent chromium. Where the chromium is present in amounts less than about 20 weight percent the adherance of the scale to the unoxidized material is diminished allowing oxidized material to flake off the underlying base metal. As flaking of the oxide occurs, oxidation of the underlying metal continues until the metal is gone. Thus below about 20 weight percent chromium the oxidation resistance of the alloy rapidly decreases.

Molybdenum is present in the alloy in amounts of about 3 to 12 weight percent. Molybdenum is a strengthening alloying element providing dispersed hard complex carbide particles and precipitation hardening throughout the alloy making it abrasion resistant, stronger and tougher. Molybdenum is generally present in no more than about 12 weight percent. It has been observed in some alloys that molybdenum in amounts much greater than 12 weight percent will have a tendency to form molybdenum oxide which is volatile at about 795° C. The molybdenum oxide is easily volitalized away from the alloy at elevated temperatures resulting in catastrophic oxidation. Where molybdenum is present in amounts less than about 3 weight percent, the amount present is insufficient to provide good dispersion hardening. Preferably molybdenum is present in amounts from about 5 to 8 weight percent. Such materials provide optimum dispersion hardening combined with the minimum possibility of catastrophic failure.

Carbon is present in the alloy in amounts from about 1 to 3.5 weight percent. Generally, carbon amounts greater than about 3.5 percent cause brittleness which subjects the alloy surface to brittle failure under severe thermal or mechanical shock loading. Similar properties are observed in cast iron where a high carbon concentration results in a brittle material. Carbon amounts less than about 1 percent by weight result in a softer alloy especially at elevated temperatures. The softer materials provide inadequate wear resistance at high temperatures. The amount of carbon present is preferably from about 2.0 to 2.5 percent by weight. The preferred alloys have a substantial amount of carbide which provides good high temperature hardness and the alloy also has good toughness and resistance to brittle failure.

There may be high percentages of impurities, up to a total of 10 weight percent or more, present in the alloys of this invention. One example of a common impurity would be cobalt which is present in the common nickel, and chromium scrap in amounts of up to 5 percent. The alloys of this invention can be characterized as substantially free of cobalt despite the presence of residual cobalt. A further impurity is iron which can be present from the use of ferrochrome. The iron is present in amounts less than about 8 percent by weight. Large amounts of iron in the alloy markedly decrease corrosion resistance. Other materials will be present in greater or lesser amounts depending on their prevalence in the scrap mix or raw materials used to make the alloy of this invention.

A further understanding can be had by referring to the accompanying example in which all parts and percentages are by weight unless otherwise indicated.

EXAMPLE I

Alloys were made by mixing elemental metal powders and lampblack. The mixed powders were formed into two 60 g lots and the lots compacted in a 32mm diameter cylindrical die under a pressure of 96.5N/mm$^2$ to form two powder compacts.

The two powder compacts were arc-melted in an argon atmosphere maintained at a reduced pressure of about 50mm Hg (7kPa) and the two resulting buttons remelted together to form a 120 g button having the nominal composition of sample 1 in Table I.

Three further samples were made using metal powders but using chromium carbide ($Cr_3C_2$) instead of lampblack as the source of carbon. The samples were mixed, compacted and melted as described above. The resulting 100 g samples had the nominal composition of samples 2, 3, and 4 in Table I.

The amount of carbon present was measured to verify the amount of carbon present and the measured value is included in Table I.

TABLE I

| | Element in Wt.% Nominal | | | | | | | Measured |
|---|---|---|---|---|---|---|---|---|
| Sample | C | MN | Si | CR | NI | MO | FE | C |
| 1 | 2.0 | 0.5 | 1.0 | 29.0 | BAL | 5.0 | 3.0 | 1.62 |
| 2 | 2.0 | " | " | " | BAL | " | " | 2.01 |
| 3 | 2.4 | " | " | " | BAL | " | " | 2.36 |
| 4 | 2.8 | " | " | " | BAL | " | " | 2.77 |

Hot Hardness

Hardnesses were taken at various elevated temperatures. Specimens were placed in a heated chamber maintained at 60 microns pressure and the chamber temperature raised in increments. Hardness measurements were taken at the various temperature increments after holding the specimen at temperature for 5 minutes. The hardness was measured using a Vickers diamond pyramid indenter and a 10 kg (about 100 N) load three indentions being made at each temperature.

After cooling to room temperature the hardness indentations were measured using a Vickers optical system and the readings averaged. Where an indentation was unusual due to porosity in the specimen it was not included in the hardness values but at least two hardness measurements were taken at each temperature. The average Vickers hardnesses of the specimens at the various temperatures are tabulated in Table II.

TABLE II

| Temperature of Sample in ° C | RT | 540 | 620 | 675 | 730 | 815 | 870 |
|---|---|---|---|---|---|---|---|
| Sample | Hardness Vickers 10 Kg Load | | | | | | |
| 1 | 321 | 276 | 262 | 244 | 213 | 156 | 111 |
| 2 | 401 | 331 | 308 | 289 | 244 | 180 | 135 |
| 3 | 432 | 367 | 346 | 316 | 255 | 184 | 140 |

TABLE II-continued

| Temperature of Sample in ° C | RT | 540 | 620 | 675 | 730 | 815 | 870 |
|---|---|---|---|---|---|---|---|
| 4 | 495 | 394 | 377 | 334 | 259 | 188 | 142 |

The hardness values can be converted to an approximately corresponding brinell hardness number by using a conversion table such tables being well known in the metal working arts.

The converted hardness values are plotted as a function of temperature in the figure of the accompanying drawing. The hardness values for sample 4 are denoted by reference numeral 10 and the hardness values for sample 2 are denoted by reference numeral 12.

Various other common alloys are also charted in the figure. The compositions reference numerals, common trademarks and nominal compositions are given in Table III. The compositions given are the midpoint of the normally published composition range which is up to several percent wide. Residuals have been omitted in the interest of brevity but may be present in amounts of up to 6 - 10 percent. "Stellite" is a trademark of The Stellite Division of Cabot Corporation, Kokomo, Ind., and "Cobend" is a trademark of Arcos Incorporated, Philadelphia, Penn.

TABLE III

| | | Composition In Wt. % | | | |
|---|---|---|---|---|---|
| Reference Numeral | Trade Name | C | Cr | W | Co |
| 14 | "Stellite" 1 | 2.8 | 30 | 12.75 | Balance |
| 16 | "Stellite" 6 | 1.15 | 28 | 4.5 | Balance |
| 18 | "Stellite" F | 1.75 | 25 | 12 | Balance |
| 20 | "Cobend" 6 | 1.15 | 28 | 4.5 | Balance |

The hardness data for the "Stellite" and "Cobend" alloys was taken from literature published by companies producing these alloys.

As shown by the figure the alloys of this invention reference numerals 10 and 12 have good high temperature hardness particularly at temperatures up to and somewhat beyond 1200° F. In fact, the alloy containing about 2.8 weight percent carbon and 5 weight percent molybdenum, represented by numeral 10, has a very high temperature hardness approximately equaling that of "Stellite" 1 which is the hardest material of the hard surfacing alloys listed above. It is surprising that a relatively inexepnsive alloy can have the same high temperature hardness as the much more expensive "Stellite" 1. In addition the alloys have shown an improved resistance to lead oxide corrosion.

Various modifications and alterations will become obvious to those skilled in the art without departing from the scope and spirit of this invention and it is to be understood that this invention is not to be limited to the illustrative example given.

What is claimed is:

1. An article of manufacture comprising an internal combustion engine component having a portion which is simultaneously subjected to abrasive wear and combustion oxide induced corrosion at elevated temperatures and having said portion coated with a nickel based alloy consisting essentially of: about 1.0 to 3.5 percent by weight carbon, about 25 to 40 percent by weight cromium, about 3 to 12 percent by weight molybdenum, and about 40 to 70 percent by weight nickel.

2. The article of claim 1 where said engine component is an engine poppet valve and said portion comprises the seating surface thereof.

3. The article of claim 1 where said engine component is a valve seat for an engine poppet valve.

4. The structural element of claim 1 where said engine component is a precombustion chamber for an internal combustion engine.

5. The article of claim 1 where said alloy has about 2.0 to 2.5 percent by weight carbon.

6. The article of claim 1 wherein said engine component comprises a valve member adapted for contact with a valve seat and said portion comprises the seating surface of said valve member.

7. The article of claim 1 wherein said engine component comprises a valve seat adapted for contact with a moveable valve member and said portion comprises the seating surface of said valve seat.

* * * * *